US008199953B2

(12) United States Patent
Buccafusca

(10) Patent No.: US 8,199,953 B2
(45) Date of Patent: Jun. 12, 2012

(54) MULTI-APERTURE ACOUSTIC HORN

(75) Inventor: Osvaldo Buccafusca, Ft. Collins, CO (US)

(73) Assignee: Avago Technologies Wireless IP (Singapore) Pte. Ltd., Singapore (SG)

( * ) Notice: Subject to any disclaimer, the term of this patent is extended or adjusted under 35 U.S.C. 154(b) by 698 days.

(21) Appl. No.: 12/261,244

(22) Filed: Oct. 30, 2008

(65) Prior Publication Data

US 2010/0109481 A1 May 6, 2010

(51) Int. Cl.
*H04R 1/20* (2006.01)

(52) U.S. Cl. ..... 381/342; 381/340

(58) Field of Classification Search ..... 381/340–343
See application file for complete search history.

(56) References Cited

U.S. PATENT DOCUMENTS

| | | | | |
|---|---|---|---|---|
| 2,381,174 | A * | 8/1945 | Massa | 381/190 |
| 4,157,741 | A * | 6/1979 | Goldwater | 381/342 |
| 4,524,846 | A * | 6/1985 | Whitby | 181/152 |
| 4,550,221 | A | 10/1985 | Mabush et al. | |
| 4,686,332 | A | 8/1987 | Greanias | |
| 4,836,327 | A * | 6/1989 | Andrews et al. | 181/152 |
| 5,025,886 | A * | 6/1991 | Jung | 181/156 |
| 5,117,462 | A * | 5/1992 | Bie | 381/343 |
| 5,138,118 | A | 8/1992 | Russell | |
| 5,206,465 | A * | 4/1993 | Jung | 181/152 |
| 5,305,017 | A | 4/1994 | Gerpheide | |
| 5,526,456 | A * | 6/1996 | Heinz | 381/340 |
| 5,543,588 | A | 8/1996 | Bissett et al. | |
| 5,543,589 | A | 8/1996 | Buchana et al. | |
| 5,670,755 | A | 9/1997 | Kwon | |
| 5,844,506 | A | 12/1998 | Binstead | |
| 5,861,875 | A | 1/1999 | Gerpheide | |
| 5,898,788 | A * | 4/1999 | Kim | 381/341 |
| 5,920,309 | A | 7/1999 | Bisset et al. | |
| 6,002,389 | A | 12/1999 | Kasser | |
| 6,028,947 | A * | 2/2000 | Faraone et al. | 381/340 |
| 6,097,991 | A | 8/2000 | Hamel et al. | |
| 6,377,249 | B1 | 4/2002 | Mumford | |
| 6,389,144 | B1 * | 5/2002 | Lee | 381/340 |
| 6,528,741 | B2 | 3/2003 | Walker | |
| 6,628,796 | B2 * | 9/2003 | Adamson | 381/342 |
| 6,658,127 | B1 * | 12/2003 | Kim | 381/340 |
| 6,784,876 | B1 | 8/2004 | Nagai | |
| 6,879,930 | B2 | 4/2005 | Sinclair | |
| 6,981,570 | B2 * | 1/2006 | Dalbec | 181/182 |
| 7,014,099 | B2 | 3/2006 | Crisan | |

(Continued)

FOREIGN PATENT DOCUMENTS

WO WO-03/063005 7/2003

(Continued)

OTHER PUBLICATIONS

U.S. Appl. No. 11/945,832, filed Nov. 27, 2007, Harley.

(Continued)

*Primary Examiner* — Lincoln Donovan
*Assistant Examiner* — Alexander Talpalatskiy

(57) ABSTRACT

A device, for transmitting or receiving ultrasonic signals, includes a transducer and an acoustic horn. The transducer is configured to convert between electrical energy and the ultrasonic signals, and may be a micro electromechanical system (MEMS) transducer. The acoustic horn is coupled to the transducer, and includes multiple apertures through which the ultrasonic signals are transmitted or received in order to manipulate at least one of a radiation pattern, frequency response or magnitude of the ultrasonic signals. The multiple apertures have different sizes.

14 Claims, 5 Drawing Sheets

U.S. PATENT DOCUMENTS

| | | | | |
|---|---|---|---|---|
| 7,158,117 | B2 | 1/2007 | Sato et al. | |
| 7,177,437 | B1 | 2/2007 | Adams | |
| 7,202,859 | B1 | 4/2007 | Speck | |
| 7,436,393 | B2 | 10/2008 | Hong | |
| 7,466,837 | B2 * | 12/2008 | Nakamura | 381/337 |
| 7,538,760 | B2 | 5/2009 | Hotelling et al. | |
| 7,650,006 | B2 * | 1/2010 | Isotalo | 381/340 |
| 2003/0025679 | A1 | 2/2003 | Taylor et al. | |
| 2004/0264690 | A1 | 12/2004 | Coates | |
| 2005/0057534 | A1 | 3/2005 | Charlier | |
| 2005/0171714 | A1 | 8/2005 | Ely | |
| 2006/0062420 | A1 * | 3/2006 | Araki | 381/396 |
| 2006/0097991 | A1 | 5/2006 | Hotelling et al. | |
| 2007/0139359 | A1 | 6/2007 | Voelckers | |
| 2007/0195069 | A1 | 8/2007 | Kable | |
| 2007/0229464 | A1 | 10/2007 | Hotelling et al. | |
| 2007/0257890 | A1 | 11/2007 | Hotelling et al. | |
| 2007/0273673 | A1 | 11/2007 | Park et al. | |
| 2008/0042985 | A1 | 2/2008 | Katsuhito | |
| 2008/0055279 | A1 | 3/2008 | Osada et al. | |
| 2008/0158178 | A1 | 7/2008 | Hotelling et al. | |
| 2008/0246496 | A1 | 10/2008 | Hristov | |
| 2009/0135918 | A1 | 5/2009 | Mak-Fan et al. | |
| 2009/0231305 | A1 | 9/2009 | Hotelling et al. | |
| 2009/0255737 | A1 | 10/2009 | Chang et al. | |
| 2009/0267920 | A1 | 10/2009 | Faubert et al. | |
| 2010/0006350 | A1 | 1/2010 | Elias | |

FOREIGN PATENT DOCUMENTS

| | | |
|---|---|---|
| WO | WO-03/063006 | 7/2003 |

OTHER PUBLICATIONS

"Avago Technologies AMRI-2000 Data Sheet".

Alternative Method Research, "Phone Keyboard → Phone Keyboard Statistics", http://phonekeyboard.com/.

Breen, Christopher, "Microsoft Zune Impressions—part 1", http://www.digitalartsonline.co.uk/blogs/index.cfm?blogid=2&entryid=184 Dec. 4, 2006, 1-4.

* cited by examiner

MULTI-APERTURE ACOUSTIC HORN

BACKGROUND

Acoustic micro electromechanical system (MEMS) transducers, such as ultrasonic transducers, are typically more efficient than traditional transducers. However, due to their small size, MEMS transducers have lower effective output power, lower sensitivity and/or broader (less focused) radiation patterns.

Radiation patterns of acoustic MEMS transducers and other miniature ultrasonic transducers may be manipulated by grouping the transducers into arrays, separated by predetermined distances, in order to provide a desired pattern. By controlling the separation and size of the array elements, as well as the phase among them, the acoustic radiation pattern may be focused or collimated, and also steered. However, the spacing among multiple transducers is limited by the physical size of each transducer. Further, the use of multiple transducers, possibly having different sizes, increases costs and raises potential compatibility and synchronization issues.

SUMMARY

In a representative embodiment, a device for transmitting or receiving ultrasonic signals includes a transducer and an acoustic horn coupled to the transducer. The transducer is configured to convert between electrical energy and the ultrasonic signals. The acoustic horn includes multiple apertures through which the ultrasonic signals are transmitted or received in order to manipulate at least one of a radiation pattern, frequency response or magnitude of the ultrasonic signals. The apertures have corresponding different aperture sizes.

In another representative embodiment, a device for transmitting ultrasonic signals includes a micro electromechanical system (MEMS) transducer configured to convert electrical energy into acoustic signals, and an acoustic horn coupled to the transducer for amplifying the ultrasonic signals. The acoustic horn includes multiple horn structures having a common throat opening for receiving the ultrasonic signals from the transducer. The multiple horn structures include a center horn structure and multiple peripheral horn structures. Dimensions of at least two of the horn structures are different.

In another representative embodiment, a device for transmitting ultrasonic signals includes a MEMS transducer configured to convert electrical energy to the ultrasonic signals, and an acoustic horn coupled to the transducer for amplifying the ultrasonic signals. The acoustic horn includes a throat portion adjacent to the MEMS transducer for receiving the ultrasonic signals and mouth portion larger in area than the throat portion. The device also includes an acoustic lens structure attached to the mouth portion of the acoustic horn, the lens structure defining a predetermined pattern of openings, through which the ultrasonic signals are transmitted, for manipulating a radiation pattern of the signals.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Generally, horns may be used to amplify acoustic waves, as indicated by the incorporation of horns in various musical instruments and early hearing aids, for example. Horns may also be used to manipulate radiation patterns of acoustic emitters, including ultrasonic transducers.

Figure 1A:
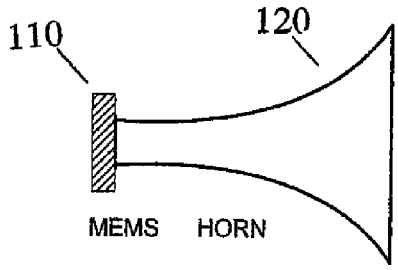
FIGS. 1A and 1B are cross-sectional diagrams illustrating acoustic horns for a transducer, according to a representative embodiment.

FIG. 1A is a cross-sectional diagram illustrating an acoustic horn for an ultrasonic or micro electromechanical system (MEMS) transducer, according to a representative embodiment. As shown in FIG. 1, an acoustic horn 120 is directly coupled to a single ultrasonic transducer 110 (e.g., in contact with the transducer 110 surface). For example, the acoustic horn 120 may be physically attached to the transducer 110, e.g., by gluing, soldering or bonding. Alternatively, the combined acoustic horn 120 and the transducer 110 may be positioned relative to one another within a package, holding each element in place. The horn 120 provides better impedance matching, acoustic amplification or radiation pattern control than the transducer 110 alone, in both transmit or receive modes.

Figure 1B:
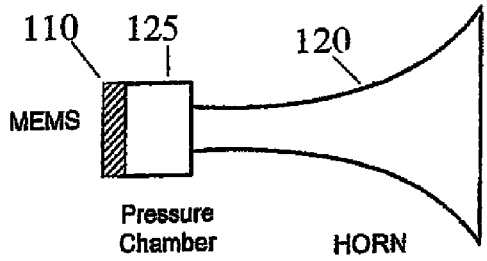

FIG. 1B is a cross-sectional diagram illustrating an alternative configuration of an acoustic horn for a MEMS transducer, according to a representative embodiment. As shown in FIG. 1B, acoustic horn 120 is coupled to a single ultrasonic transducer 110 by means of pressure chamber 125. This is configuration may be implemented, for example, when the acoustic horn 120 is not above to touch the surface of the transducer 110. For example, the presence of wire-bonds may prevent a direct coupling, thus requiring the addition of the pressure chamber 125 for coupling the acoustic horn 120 and the transducer 110. Dimensions of the pressure chamber 125 are less than the acoustic wavelength corresponding to the transducer 110, as would be appreciated by one skilled in the art.

Figure 2A:
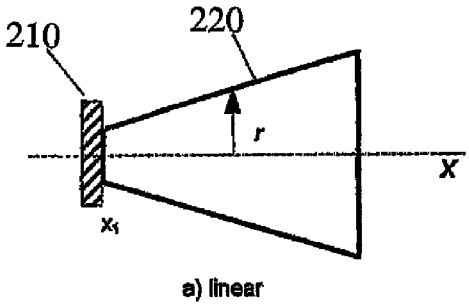
FIGS. 2A and 2B are cross-sectional diagrams illustrating acoustic horns for a transducer, according to a representative embodiment.
Figure 2B:
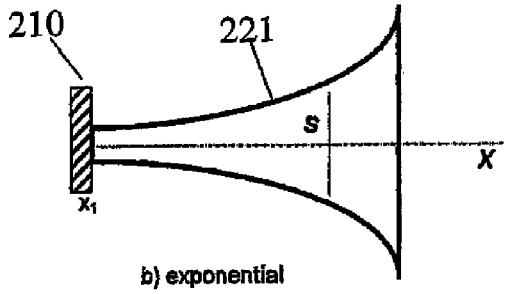

FIGS. 2A and 2B are cross-sectional diagrams illustrating acoustic horns for an ultrasonic transducer, according to representative embodiments. Acoustic horns are generally tubular in shape with circular cross-sections at opposing end openings, where one end (e.g., closest to the acoustic transducer) is typically more narrow than the other. The narrower opening close to the transducer may be referred to as the throat or throat opening of the horn, and the larger opening may be referred to as the mouth or mouth opening of the horn.

FIG. 2A shows an example of an ultrasonic transducer 210, such as a MEMS transducer, coupled to an acoustic horn 220 having a cross-section of diverging linear sidewalls, which may be referred to as a conical horn since the tube has a generally conical shape. Radius r at any location along the x axis of the acoustic horn 220 may be represented by the following formula, in which $r_1$ is the radius at location $x_1$ of the acoustic horn 220 (the horn throat) and m is a real number greater than 1:

$$r(x)=mx+r_1$$

A cylinder is a special case of the conical acoustic horn 220 in which m=0, such that the radius r at any location x along the cylindrical acoustic horn 220 is equal to $r_1$ of the end opening.

FIG. 2B shows an example of an ultrasonic transducer 210, such as a MEMS transducer, coupled to an acoustic horn 221 having a cross-section of exponentially curved sidewalls, which may be referred to as an exponential horn. In the acoustic horn 221, area S at any location along the x axis of the acoustic horn 221 may be represented by the following exponential formula, in which $S_1$ is area at point $x_1$ of the acoustic horn 221 (the horn throat) and m is a real number greater than 1:

$$S(x)=S_1e^{mx}$$

It is understood that other implementations may include an acoustic horn having end openings that are not circular, such as rectangular, square, polygonal and elliptical openings, as well as other functional dependencies of the radius of the horn. Of course, the size and/or shape of the acoustic horn may vary to provide unique benefits for any particular situation or to meet application specific design requirements of various implementations, as would be apparent to one skilled in the art.

Due to its small size, an ultrasonic acoustic transmitter, e.g., with a MEMS transducer, has a broad radiation pattern. In many applications, a focused acoustic beam is desired because the acoustic wave is detected within a confined area. Therefore, manipulating the radiation pattern to direct or focus transmitted energy improves energy efficiency. A conventional technique to achieve this improvement uses arrays of transducers, but this approach increases cost and complexity of the transducers. By using diffraction effects, manipulating aperture shapes and acoustic delays, for example, it is possible to shape an acoustic beam from a single transducer at will, as discussed below.

Figure 3:
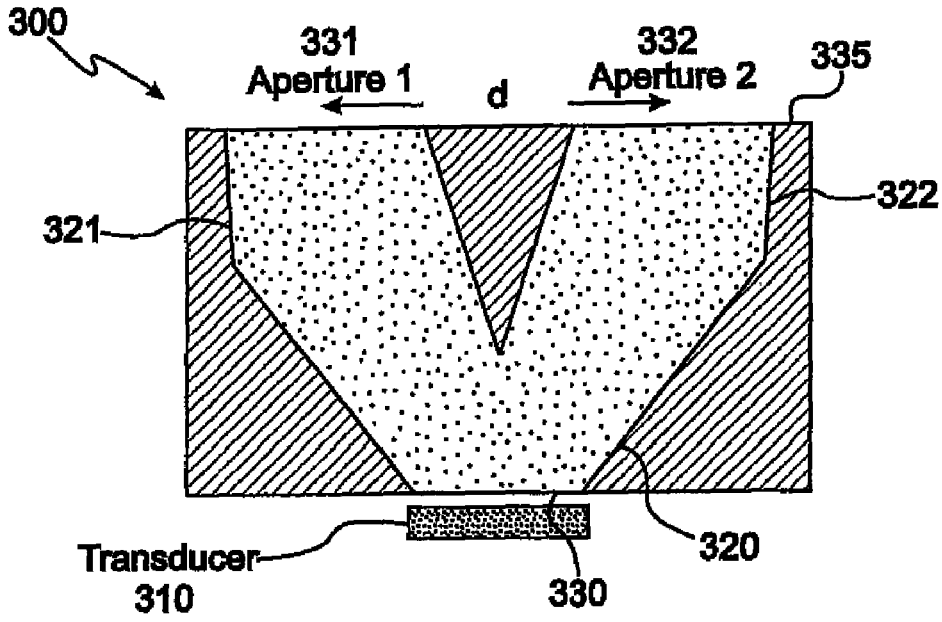
FIG. 3 is a cross-sectional diagram illustrating a multi-aperture acoustic horn, according to a representative embodiment.

FIG. 3 is a cross-sectional diagram illustrating a multi-aperture acoustic horn, according to a representative embodiment. As shown in FIG. 3, acoustic device 300 includes an acoustic MEMS transducer 310, such as an ultrasonic transducer, positioned at the base or throat of multi-aperture acoustic horn 320, which amplifies the ultrasonic signals. The multi-aperture acoustic horn 320 includes combined horn structures 321 and 322, which have a combined throat aperture 330 and separate corresponding mouth apertures 331 and 332, which form array 335. The multi-aperture configuration of the acoustic horn 320 enables manipulation of the radiation pattern (e.g., beam conditioning or beam forming) transmitted by the transducer 310 in an ultrasonic emitter, such as a MEMS transmitter. Likewise, the multi-aperture configuration of the multi-aperture acoustic horn 320 enables manipulation of directionality and frequency response of the transducer 310 in an ultrasonic receiver, such as a MEMS receiver.

In various embodiments, the transducer 310 may be any type of miniature acoustic transducer for emitting ultrasonic waves. For purposes of explanation, it is assumed that the acoustic device 300 is a MEMS transmitter and the transducer 310 is operating in a transmit mode. That is, the transducer 310 receives electrical energy from a signaling source (not shown), and emits ultrasonic waves via the multi-aperture acoustic horn 320 corresponding to vibrations induced by the electrical input. It is understood that the configuration depicted in FIG. 3 may likewise apply to an acoustic device 300 that is a MEMS receiver, in which case the transducer 310 operates in a receive mode. That is, the transducer 310 receives ultrasonic waves from an acoustic source (not shown) collected through the multi-aperture acoustic horn 320 and converts the sound into electrical energy. It would be apparent to one of ordinary skill in the art that various implementations may provide different types, sizes and shapes of transducers, without departing from the spirit and scope of the present disclosure.

The multi-aperture acoustic horn 320 may be formed from any material capable of being formed into predetermined shapes to provide the desired radiation pattern characteristics, which may be referred to as beam conditioning or beam forming. For example, the acoustic horn structures 321 and 322 of the multi-aperture acoustic horn 320 may be formed from a lightweight plastic or metal. Also, the acoustic horn structures 321 and 322 are relatively small. For example, the throat aperture 330 may be approximately 0.5 to 1.0 mm in diameter and each of the mouth apertures 331 and 332 may be approximately 2.0 to 5.0 mm in diameter. The length of each acoustic horn structure 321 and 322 may be approximately 5.0 to 10 mm in length, as measured from the center of the common throat aperture 330 to the center of each corresponding mouth apertures 331 or 332. It is understood that, in various embodiments, the mouth aperture 331 may have a different diameter than the mouth aperture 332 for various effects on the radiation pattern.

The multi-aperture acoustic horn 320 is acoustically coupled to the transducer 310, either directly or through a pressure chamber (not shown), as discussed above with respect to FIG. 1, thus capturing, amplifying and directing ultrasonic waves emitted from (or sent to) the transducer 310.

The radiation pattern emitted by the transducer 310 may be manipulated by altering the distance d between the mouth apertures 331 and 332 of the array 300, as well as by altering the size and/or shape of the acoustic horn structures 321 and 322. For example, the distance d may range from one half (½) to approximately one (1) wavelength λ of ultrasonic waves emitted by the transducer 310. Also, as shown in the embodiment depicted in FIG. 3 (as well as FIG. 2A, above), the sides of the acoustic horn structures 321 and 322 may be straight, which simplifies the manufacturing process. However, the distance d and the size and/or shape of the acoustic horn structures 321 and 322 and corresponding mouth apertures 331 and 332 may vary to provide unique benefits for any particular situation or to meet application specific design requirements of various implementations, as would be apparent to one skilled in the art.

Figure 4:
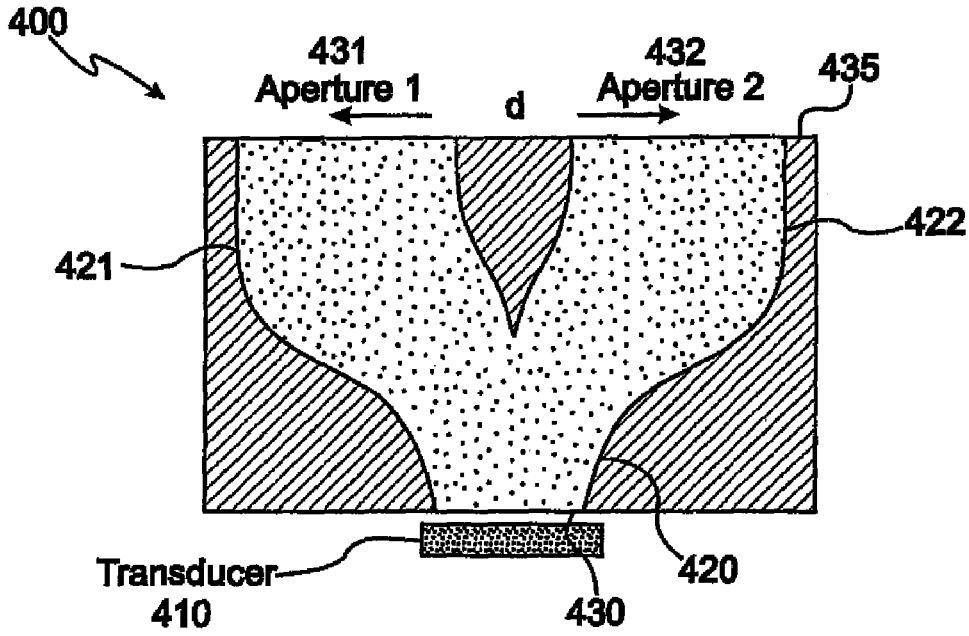
FIG. 4 is a cross-sectional diagram illustrating a multi-aperture acoustic horn, according to a representative embodiment.

FIG. 4 is a cross-sectional diagram illustrating a multi-aperture acoustic horn, according to another representative embodiment. As shown in FIG. 4, the acoustic device 400 includes a single MEMS transducer 410, such as an ultrasonic transducer, positioned at the base of multi-aperture acoustic horn 420, which amplifies the ultrasonic signals. The multi-aperture acoustic horn 420 includes combined horn structures 421 and 422, which have a combined throat aperture 430 and separate corresponding mouth apertures 431 and 432, to form array 435. In the depicted illustrative embodiment, the mouth apertures 431 and 432 of the array 435 are circular, and are separated from one another by a distance d, the value of which is determined based on the desired radiation pattern of the transducer 410, as discussed above with respect to FIG. 3. Also, in various embodiments, the mouth aperture 431 may have a different diameter than the mouth aperture 432 for various effects on the radiation pattern.

The acoustic device 400 differs from the acoustic device 300 of FIG. 3 in that the cross-sectional sides of the acoustic horn structures 421 and 422 are not linear. Rather, like the acoustic horn 221 shown in FIG. 2B, the acoustic horn structures 421 and 422 are curved. The dimensions and shape of the curves may be altered to provide desired affects on the radiation pattern, frequency response and efficiency. The multi-aperture acoustic horn 420 enables more precise manipulation of the radiation pattern when compared to the acoustic horn 320. However it is more difficult to manufacture. Also, the size, shape and spacing (e.g., the distance d) of the acoustic horn structures 421 and 422 and corresponding mouth apertures 431 and 432 may vary to provide unique benefits for any particular situation or to meet application specific design requirements of various implementations, as would be apparent to one skilled in the art.

Although FIGS. 3 and 4 depict representative acoustic horn structures 310 and 410 forming corresponding arrays 300 and 400, which are linear arrays having two apertures, it is understood that arrays having three, four or more apertures may be implemented, using a single transducer. Linear or two dimensional arrangements can be implemented, depending on the desired radiation pattern. For example, FIG. 5 is a cross-sectional diagram illustrating a multi-aperture acoustic horn having a two-dimensional array consisting of four apertures, according to another representative embodiment.

Figure 5:
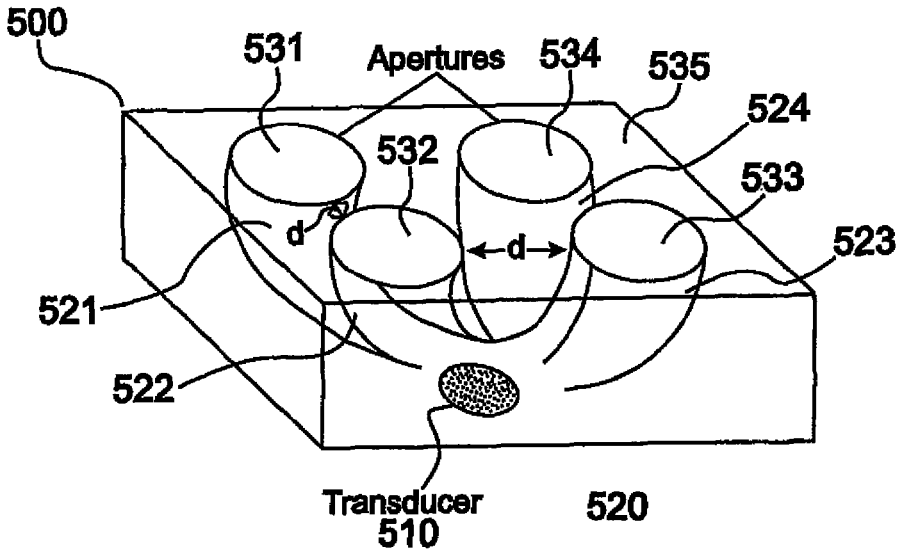
FIG. 5 is a plan view illustrating a multi-aperture acoustic horn, according to a representative embodiment.

More particularly, as shown in FIG. 5, acoustic device 500 includes a single MEMS transducer 510, such as an ultrasonic transducer, positioned at the base of multi-aperture acoustic horn 520, which amplifies the ultrasonic signals. The multi-aperture acoustic horn 520 includes four acoustic horn structures 521, 522, 523 and 524, which have a combined throat aperture (not shown) and four separate corresponding mouth apertures 531, 532, 533 and 534 aligned to form two-dimensional array 535. The mouth apertures 531-534 are separated from one another by a distance d in a first direction and a distance d' in a second direction, which is perpendicular to the first direction. In an embodiment, the distance d and the distance d' may be equal, for example. Also, in the depicted illustrative embodiment, the throat apertures 531-534 are circular in shape.

The resulting radiation pattern of ultrasound signals may be manipulated in shape and directivity, for example, by changing the sizes, shapes and spacing (i.e., distances d and d') of the mouth apertures 531-534, as well as changing the sizes and/or shapes of the acoustic horn structures 521-524, in order to provide unique benefits for any particular situation or to meet application specific design requirements of various implementations, as would be apparent to one skilled in the art. For example, although the acoustic horn structures 521-524 are shown as having generally curved cross-sectional shapes, as shown in FIG. 4, they may have linear cross-sectional shapes, as shown in FIG. 3, in alternative embodiments. Also, all or some of the mouth apertures 531-534 may have different diameters from one another for various effects on the radiation pattern.

Figure 6:
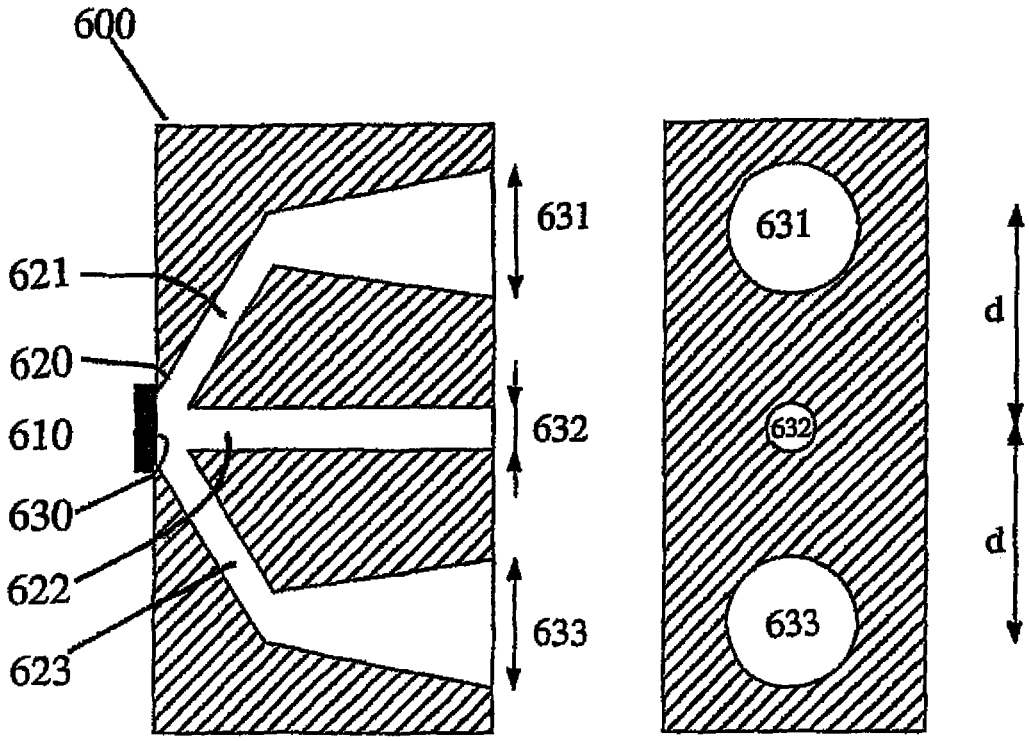
FIG. 6 is a cross-sectional diagram illustrating a multi-aperture acoustic horn, according to a representative embodiment.

FIG. 6 is a cross-sectional diagram illustrating a multi-aperture acoustic horn having a linear array with three apertures, according to another representative embodiment. This particular embodiment addresses manipulation of a radiation pattern to improve efficiency of a conventional three-transducer system, using a single transducer with a multi-aperture acoustic horn, where receivers are located at complementary angles of ±30 degrees from the transducer. Variations of this embodiment, such as aperture placement and size, may produce two or mode lobes, at complementary or non-complementary angles.

More particularly, as shown in FIG. 6, acoustic device 600 includes a single MEMS transducer 610, such as an ultrasonic transducer, positioned at the throat of multi-aperture acoustic horn 620, which amplifies the ultrasonic signals. The multi-aperture acoustic horn 620 includes three acoustic horn structures 621, 622 and 623, which have a combined throat aperture 630 and three separate corresponding mouth apertures 631, 632 and 633 aligned to form linear array 635. In the depicted illustrative embodiment, the mouth apertures 631, 632 and 633 are circular in shape, and are separated from one another by distance d. The resulting transmission of ultrasonic waves from the transducer 610 thus results in multiple radiation lobes, which may be altered in shape and directivity, for example, by changing the sizes and/or shapes of the mouth apertures 631, 632 and 633, as well as changing the sizes and/or shapes of the acoustic horn structures 621, 622 and 623 and/or the distance d, in order to provide unique benefits for any particular situation or to meet application specific design requirements of various implementations, as would be apparent to one skilled in the art.

For example, in the depicted embodiment, the center mouth aperture 632 of the array 600 is smaller in diameter than the adjacent outer or peripheral mouth apertures 631 and 633. The center acoustic horn structure 622 is shorter in length than each of the peripheral acoustic horn structures 621 and 623. Also, the center acoustic horn structure 622 is tubular with substantially parallel sides, while each of the peripheral acoustic horn structures 621 and 623 includes a tubular inner portion having substantially parallel sides and a conical outer portion having diverging linear sides (e.g., as discussed above with respect to FIG. 2A). The combined result is a radiation pattern of ultrasonic waves emitted from the transducer 610 that includes a small center lobe with two larger outer lobes directed at complementary angles from the center lobe. As stated above, the mouth apertures 631, 632 and 633 of the array 600 are separated by a distance d, the value of which is determined based on the desired radiation pattern.

Illustrative applications of ultrasonic transducers include, for example, gas flow and wind measurement, for which multiple transducer paths are needed to determine speed and direction of the gas. Conventionally, this requires use of multiple transducers. However, the same results may be obtained using single transducer 610 and multi-aperture acoustic horn 620, enabling efficient transmission to multiple receivers at different placements with significant directionality, thus reducing the number of transducer needed.

For purposes of illustration, an example of a specific radiation pattern from transducer 610 is set forth below, with reference to FIGS. 6 and 7B. It is understood, however, that the various dimensions and parameters are for explanation purposes, and the various embodiments are not restricted thereto.

Figure 7A:
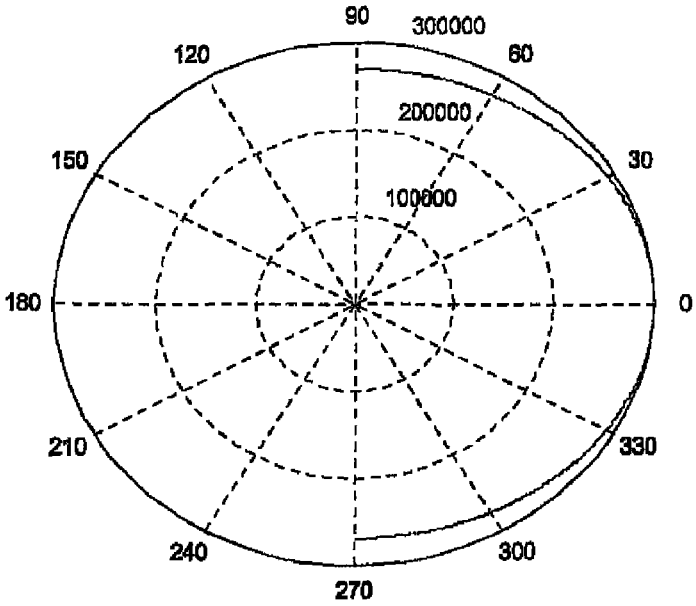
FIG. 7A Prior Art
FIG. 7A is a conventional ultrasonic radiation pattern.
Figure 7B:
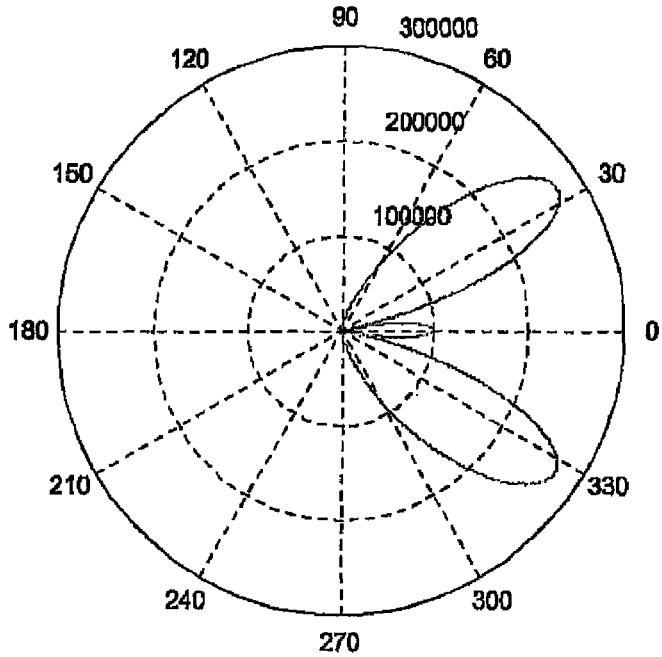
FIG. 7B is an ultrasonic radiation pattern of a multi-aperture acoustic horn, according to a representative embodiment.

Assuming that an acoustic MEMS transducer is circular and has a diameter of 1.0 mm, the calculated radiation pattern (e.g., at 100 KHz) is shown in FIG. 7A, where the transducer is located at the origin of the polar plot, which indicates relatively spaced concentric circles from the origin. In particular, the broad radiation pattern from the transducer is generally circular and uniform over 180 degrees (e.g., 90 degrees through 270 degrees). Accordingly, although two receivers located at ±30 degrees, for example, would be able to detect the emission, efficiency would be low since much of the radiated energy is lost across the broad radiation pattern. This system is also susceptible to reflections and interference due to the non-directionality.

However, using the three-aperture linear array 635 of the multi-aperture horn structure 620, as shown in FIG. 6, the transducer 610 is able to improve directionality. For example, each of the peripheral mouth apertures 631 and 633 may have a diameter of 2.0 mm, the center mouth aperture 632 may have a diameter of 0.6 mm, and the distance d between adjacent apertures 631-632 and 632-633 may be 3.0 mm. In this illustrative configuration, the radiation pattern of the single transducer 610 is shown in FIG. 7B, where the transducer 610 is located at the origin of the polar plot. In particular, the radiation pattern from the transducer 610 has two large side lobes having cords extending from the transducer 610 at complementary angles of approximately ±30 degrees. Accordingly, two receivers located at ±30 degrees from the transducer 610, for example, would receive the directed acoustic energy and thus more efficiently and reliably detect the emission, with minimal lost radiated energy. Further, the multi-aperture horn 620 provides a shorter acoustic path through the center acoustic horn structure 622 corresponding to the center mouth aperture 632, creating a delay (e.g., of about a half wavelength) for the adjacent peripheral mouth apertures 631 and 633, so that destructive interference minimizes the center emission.

Although a similar radiation pattern may be obtained using multiple transducers (as opposed to a single transducer 610) arranged to form a transducer array, the use of the single transducer 610 reduces material costs. Further, the design of transducers with different diameters on the same wafer with the same frequency adds complexity to the manufacturing process. Also, manipulation of the required phase differences among three separate transducers arranged in an array requires external circuitry, which adds further cost to the system and implementation difficulties. Moreover, the manipulation of the geometry of each aperture allows acoustic amplification in the desired apertures.

Figure 8:
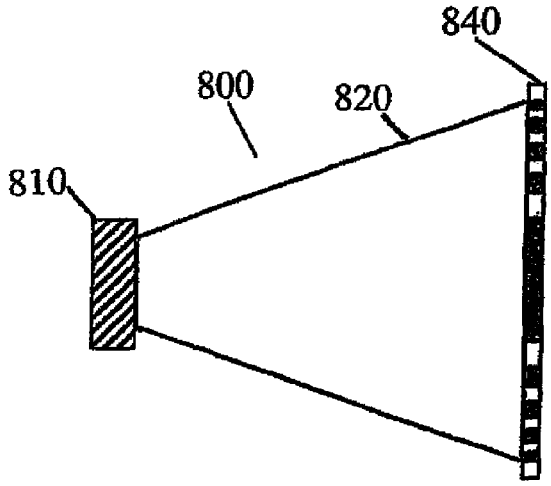
FIG. 8 is a cross-sectional diagram illustrating a multi-aperture acoustic horn, according to a representative embodiment.

FIG. 8 is a cross-sectional diagram illustrating a multi-aperture acoustic horn, according to another representative embodiment. Referring to FIG. 8, acoustic device 800 includes an ultrasonic transducer 810 coupled to acoustic horn 820, either directly or through a pressure chamber (not shown), as discussed above. The acoustic horn 820 has a conical shape with a cross-section having diverging linear sides extending away from the transducer 810 for amplifying the ultrasonic signals. An acoustic diffraction lens 840, having multiple apertures arranged in a predetermined pattern, is attached to the mouth of the acoustic horn 820. The predetermined pattern may include any design for directing ultrasonic waves in a desired radiation pattern. For example, in various embodiments, the lens 840 may be a Fresnel-like lens having a predetermined Fresnel aperture pattern.

Figure 9B:
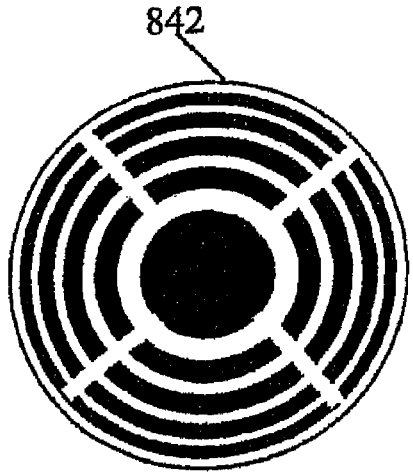
FIGS. 9A-9C are plan views illustrating Fresnel patterns of a multi-aperture acoustic horn, according to representative embodiments.
Figure 9A:
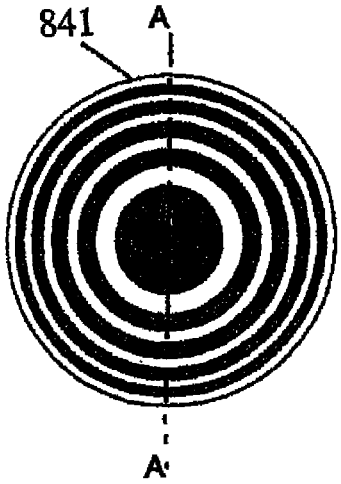
Figure 9C:
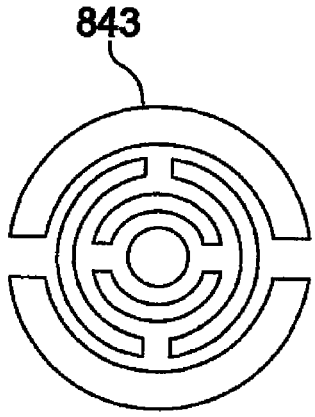

FIGS. 9A, 9B and 9C are plan views illustrating representative Fresnel patterns of a multi-aperture acoustic horn, according to representative embodiments, which may be used for the lens 840.

In particular, FIG. 9A shows a binary Fresnel lens 841, having a pattern of concentric circles of alternating Fresnel zones, in which the shaded portions indicate openings (or apertures) through which ultrasonic signals may pass (i.e., not blocked). A cut-away view across A-A' of the lens 841 is substantially the same as the side view of lens 840 in FIG. 8.

The boundaries of the alternating zones are approximately provided in accordance with the following known formula (or similar Fresnel zone formulas), in which $R_n$ is the radius of the boundary n, λ is the wavelength of the ultrasonic signal, and $z_1$, $z_2$ are distances of the lens 840 to the source (transducer 810) and a focal point (not shown) of the lens 840, respectively:

$$R_n = \sqrt{n\lambda\left(\frac{z_1 z_2}{z_1 + z_{21}}\right)}$$

The radiation pattern is manipulated by the multiple apertures in the acoustic diffraction lens 841 mounted on the acoustic horn 820. The lens 841 may thus manipulate the acoustic wave front to focus or collimate acoustic energy. In alternative embodiments, this can likewise be achieved by shaping materials having different acoustic indexes of refraction.

FIG. 9B shows a binary Fresnel lens 842, having a similar pattern of concentric circles of alternating zones, in which the shaded portions indicate openings (or apertures) through which ultrasonic signals may pass (i.e., not blocked). Additional cross members, which generally follow the diameter of the lens 842, further provide structural support. FIG. 9C shows another illustrative Fresnel lens 843, having a pattern of concentric circles of alternating zones, in which the shaded portions indicate openings (or apertures) through which ultrasonic signals may pass (i.e., not blocked). Additional cross members, which are positioned circumferentially at different locations for the different circles, provide structural support.

The various representative embodiments have been primarily discussed from the perspective of a transducer acting in the capacity of an ultrasonic signal transmitter. However, as mentioned above, due to the acoustic reciprocity principle, the various embodiments (e.g., FIGS. 1-6, 8 and 9A-9C) may likewise be applied in the case of the transducer acting in the capacity of ultrasonic receiver.

The various components, materials, structures and parameters are included by way of illustration and example only and not in any limiting sense. In view of this disclosure, those skilled in the art can implement the present teachings in determining their own applications and needed components, materials, structures and equipment to implement these applications, while remaining within the scope of the appended claims.

The invention claimed is:

1. A device for transmitting or receiving ultrasonic signals, the device comprising:

a transducer configured to convert between electrical energy and the ultrasonic signals; and an acoustic horn coupled to the transducer, the acoustic horn comprising a plurality of horn structures having a common throat opening adjacent to the transducer and a plurality of mouth openings corresponding to a plurality of apertures through which the ultrasonic signals are transmitted or received in order to manipulate at least one of a radiation pattern, frequency response or magnitude of the ultrasonic signals, wherein the plurality of horn structures comprise a center horn structure and at least two adjacent peripheral horn structures aligned in a linear form, an aperture of the center horn structure having a different size than apertures of the at least two adjacent peripheral horn structures, and wherein the center horn structure is tubular, having parallel sides extending from the common throat opening to the aperture of the center horn structure, and each of the at least two adjacent peripheral horn structures comprises a conical outer portion extending to the aperture of the adjacent peripheral horn structure.

2. The device of claim 1, wherein the transducer comprises a micro electro-mechanical system (MEMS) transducer.

3. The device of claim 1, wherein the plurality of apertures are aligned in a two-dimensional form.

4. The device of claim 1, wherein the center horn structure has a different length than the at least two adjacent peripheral horn structures to manipulate relative phases of the ultrasonic signals respectively emitted from the corresponding plurality of apertures.

5. The device of claim 1, wherein a radiation pattern of the ultrasonic signals transmitted from the device comprise two or more lobes extending at different angles from the transducer.

6. The device of claim 1, wherein a radiation pattern of the ultrasonic signals transmitted from the device comprises one lobe at a non-zero angle from the transducer.

7. The device of claim 1, wherein the aperture of the center horn structure is smaller than the apertures of the at least two adjacent peripheral horn structures.

8. The device of claim 1, wherein each of the at least two adjacent peripheral horn structures further comprises a tubular inner portion, the corresponding a conical outer portion extending from the tubular inner portion to the aperture of the adjacent peripheral horn structure.

9. The device of claim 8, wherein each of the plurality of apertures is circular in shape.

10. An acoustic horn coupled to a micro electro-mechanical system (MEMS) transducer for transmitting and receiving ultrasonic signals, the acoustic horn comprising:

a center horn structure defined between a common throat opening in communication with the MEMS transducer and a center aperture, the center horn structure having a tubular shape with parallel sides extending from the common throat opening to the center aperture;

a first peripheral horn structure defined between the common throat opening and a first peripheral aperture, at least a portion of the first peripheral horn structure having a conical shape extending to the first peripheral aperture; and a second peripheral horn structure defined between the common throat opening and a second peripheral aperture, at least a portion of the second peripheral horn structure having a conical shape extending to the second peripheral aperture.

11. A device for transmitting ultrasonic signals, the device comprising:

a micro electro-mechanical system (MEMS) transducer configured to convert electrical energy into acoustic signals; and an acoustic horn coupled to the transducer for amplifying the ultrasonic signals, the acoustic horn comprising a plurality of horn structures having a common throat opening for receiving the ultrasonic signals from the transducer, the plurality of horn structures comprising a center horn structure and a plurality of peripheral horn structures, wherein the center horn structure has a tubular shape extending from the common throat opening to a corresponding mouth aperture, and each of the plurality of peripheral horn structures has a conical shape extending to a corresponding mouth aperture, and wherein dimensions of at least two of the plurality of horn structures being different.

12. The device of claim 11, wherein at least one of the plurality of peripheral horn structures comprises a tubular inner portion and a conical outer portion.

13. The device of claim 12, wherein the center horn structure creates a delay of about a half wavelength of a portion of the ultrasonic signals transmitted through each of the plurality of peripheral horn structures.

14. The device of claim 11, wherein a center point of the mouth aperture of the center horn structure is the same distance from a center point of the mouth apertures of each of the plurality of peripheral horn structures.

* * * * *